US008082702B2

(12) United States Patent
Hill

(10) Patent No.: US 8,082,702 B2
(45) Date of Patent: Dec. 27, 2011

(54) GROUND ANCHOR AND WEIGHT DISTRIBUTION PLATE FOR DECKING AND OTHER STRUCTURAL INSTALLATIONS

(75) Inventor: Ian A. Hill, Frisco, TX (US)

(73) Assignee: OZ-POST, International LLP, Dallas, TX (US)

( * ) Notice: Subject to any disclaimer, the term of this patent is extended or adjusted under 35 U.S.C. 154(b) by 191 days.

(21) Appl. No.: 12/277,751

(22) Filed: Nov. 25, 2008

(65) Prior Publication Data

US 2009/0133337 A1 May 28, 2009

Related U.S. Application Data

(60) Provisional application No. 60/990,522, filed on Nov. 27, 2007.

(51) Int. Cl.
*E02D 5/74* (2006.01)

(52) U.S. Cl. ..... 52/155; 52/160; 52/165; 52/166

(58) Field of Classification Search ..... 52/296, 52/297, 298, 741.14, 741.15, 153, 154, 156, 52/159, 160, 165, 166, 834, 835; 248/530, 248/156, 545, 218.4; D25/133; 256/65.14, 256/DIG. 5

See application file for complete search history.

(56) References Cited

U.S. PATENT DOCUMENTS

| | | | | | |
|---|---|---|---|---|---|
| 23,905 | A | * | 5/1859 | Dewey | 256/64 |
| 239,080 | A | | 3/1881 | Baker | |
| 412,766 | A | * | 10/1889 | Lounsberry | 52/154 |
| 632,966 | A | * | 9/1899 | Mullenix | 52/158 |
| 795,405 | A | * | 7/1905 | Moore | 52/157 |
| 822,131 | A | * | 5/1906 | Hyder | 52/97 |
| 1,611,935 | A | | 12/1926 | Mitchell | |
| 1,736,177 | A | * | 11/1929 | Snook | 52/157 |
| 3,066,447 | A | | 12/1962 | Reiterer et al. | |
| 3,342,444 | A | | 9/1967 | Nelson | |
| 3,531,090 | A | | 9/1970 | Liable | |
| 3,698,144 | A | * | 10/1972 | Stratton | 52/99 |
| 3,724,145 | A | * | 4/1973 | Daniel | 52/157 |
| 3,899,856 | A | | 8/1975 | Johnson | |
| 3,969,853 | A | | 7/1976 | Deike | |
| 3,974,604 | A | | 8/1976 | Conn et al. | |
| 4,021,977 | A | | 5/1977 | Deike | |
| 4,185,424 | A | | 1/1980 | Streit | |
| 4,271,646 | A | | 6/1981 | Mills et al. | |
| 4,279,104 | A | | 7/1981 | Classen | |
| 4,516,365 | A | | 5/1985 | Chapman | |
| 4,588,157 | A | | 5/1986 | Mills et al. | |
| 4,603,520 | A | | 8/1986 | Deike | |

(Continued)

FOREIGN PATENT DOCUMENTS

| | | |
|---|---|---|
| FR | 2 701 504 | 8/1994 |

(Continued)

*Primary Examiner* — Jessica Laux

(74) *Attorney, Agent, or Firm* — Andre M. Szuwalski; Gardere Wynne Sewell LLP

(57) ABSTRACT

A ground anchor and weight distribution plate assembly includes a ground anchor member and a weight distribution plate member. The weight distribution plate member includes an opening formed therein which is sized and shaped to allow for only partial passage of the ground anchor member there through. During installation, the ground anchor member is partially passed through the opening in the weight distribution plate member and then driven into the ground. Compressive forces are exerted by the weight distribution plate member to compact underlying soil and provide a foundation for construction structures such as decks.

6 Claims, 11 Drawing Sheets

U.S. PATENT DOCUMENTS

| | | | | |
|---|---|---|---|---|
| 4,615,156 | A | 10/1986 | Deike | |
| 4,795,137 | A | 1/1989 | Witt | |
| 4,831,760 | A | 5/1989 | Walker | |
| 4,860,940 | A | 8/1989 | Mills et al. | |
| 4,874,149 | A | 10/1989 | Miceli | |
| 4,923,164 | A | 5/1990 | Stenberg | |
| 4,926,785 | A * | 5/1990 | Lamson | 116/209 |
| 5,082,231 | A | 1/1992 | Knowles | |
| 5,085,281 | A | 2/1992 | Selly | |
| 5,709,366 | A | 1/1998 | Speece | |
| 5,927,677 | A | 7/1999 | Speece et al. | |
| 6,039,298 | A | 3/2000 | Stier | |
| D424,713 | S | 5/2000 | Blackwell et al.. | |
| D439,437 | S | 3/2001 | Crete et al. | |
| 6,272,798 | B1 * | 8/2001 | Cockman | 52/155 |
| 6,343,446 | B1 | 2/2002 | Beard | |
| 6,402,115 | B1 | 6/2002 | Groff et al. | |
| 6,412,235 | B1 | 7/2002 | Pylant | |
| 6,461,084 | B1 | 10/2002 | Stuart | |
| 6,560,935 | B1 | 5/2003 | Barefield et al. | |
| 6,745,990 | B2 | 6/2004 | Groff et al. | |
| D493,205 | S | 7/2004 | Combes | |
| D532,121 | S | 11/2006 | Watson et al. | |
| 7,134,636 | B2 | 11/2006 | Callies | |
| 7,152,841 | B2 | 12/2006 | Callies | |
| 7,241,079 | B2 | 7/2007 | Francis et al. | |
| D549,853 | S | 8/2007 | Walker et al. | |
| 2002/0066241 | A1 * | 6/2002 | Johnson | 52/157 |
| 2002/0066248 | A1 | 6/2002 | Buhrts et al. | |
| 2003/0014925 | A1 | 1/2003 | Cox | |
| 2003/0084620 | A1 | 5/2003 | Benincasa et al. | |
| 2005/0144888 | A1 | 7/2005 | Snyders | |
| 2005/0279896 | A1 | 12/2005 | Callies | |
| 2006/0142402 | A1 | 6/2006 | Dunnrowicz | |

FOREIGN PATENT DOCUMENTS

| | | |
|---|---|---|
| GB | 2 426 777 | 12/2006 |
| GB | 2 431 938 | 5/2007 |

* cited by examiner

GROUND ANCHOR AND WEIGHT DISTRIBUTION PLATE FOR DECKING AND OTHER STRUCTURAL INSTALLATIONS

CROSS-REFERENCE

This application claims the benefit of U.S. Provisional Application for Pat. No. 60/990522 of the same title filed on Nov. 27, 2007, the disclosure of which is hereby incorporated by reference.

BACKGROUND OF THE INVENTION

1. Technical Field of the Invention

The present invention relates generally to an accessory for use with a post anchor to provide load bearing capacity for supporting decks, sheds and other light framed construction structures. This anchor and plate device is intended to support structures with both vertical and lateral loads without the need for traditional post holes, concrete or ledger boards.

2. Description of Related Art

Foundations for decks, sheds, stairways, etc., are typically mounted to the ground by digging a hole, filling the hole with concrete and then placing the support post on top of this foundation. This process is effective but time consuming. Furthermore, extra care must be taken to be sure that the concrete footing post is deep enough and wide enough to properly protect the foundation from frost heave and settlement. This has led building inspectors to require post hole inspections to assure compliance to local building codes.

Foundation problems have also been addressed in the prior art by providing cement blocks that can sit on the ground to support the deck structure. In the prior art, an example exists of a cement block with slots for the posts to rest on to form a foundation. Examples are provided in U.S. Pat. Nos. 5,392,575, 5,953,874 and 6,609,346, the disclosures of which are hereby incorporated by reference.

The above mentioned foundation has several flaws which have limited its effectiveness. The cement block foundation technique relies on gravity to hold the deck posts to the cement footing. This is not useful in many situations where uplift can occur from wind or other similar environmental effects.

Deck blocks also do not have any means for stopping the block from sliding or moving on the surface of the ground which could present a safety concern. Furthermore, deck blocks do not provide any lateral support to the post that sits on them. Thus, additional angular bracing is required to fix the problem. This adds cost and additional labor to the construction project.

A need accordingly exists for a more effective mechanism for providing a foundation for supporting decks, sheds and other light framed construction structures.

SUMMARY OF THE INVENTION

An embodiment of the invention comprises a ground anchor and weight distribution plate assembly.

In an embodiment, the anchor and plate are separate structural items which are assembled together during installation. In an alternative embodiment, the anchor and plate form a single assembled unit.

In an embodiment, the anchor comprises a ground engaging portion and a post receiving portion. The ground engaging portion includes one or more fin members. The post receiving portion forms an opening dimensioned to be large enough in size to receive a post to be associated with said post anchor.

In an embodiment, the plate has a convex upper surface and a concave lower surface with an opening between those surfaces which is sized and shaped to receive the ground engaging portion of the anchor extending partially there through, but interact at its upper surface with the post receiving portion of the anchor.

In another embodiment, an apparatus is provided which includes a weight distribution plate and a post receiving member mounted to an upper surface of the plate.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 1A:
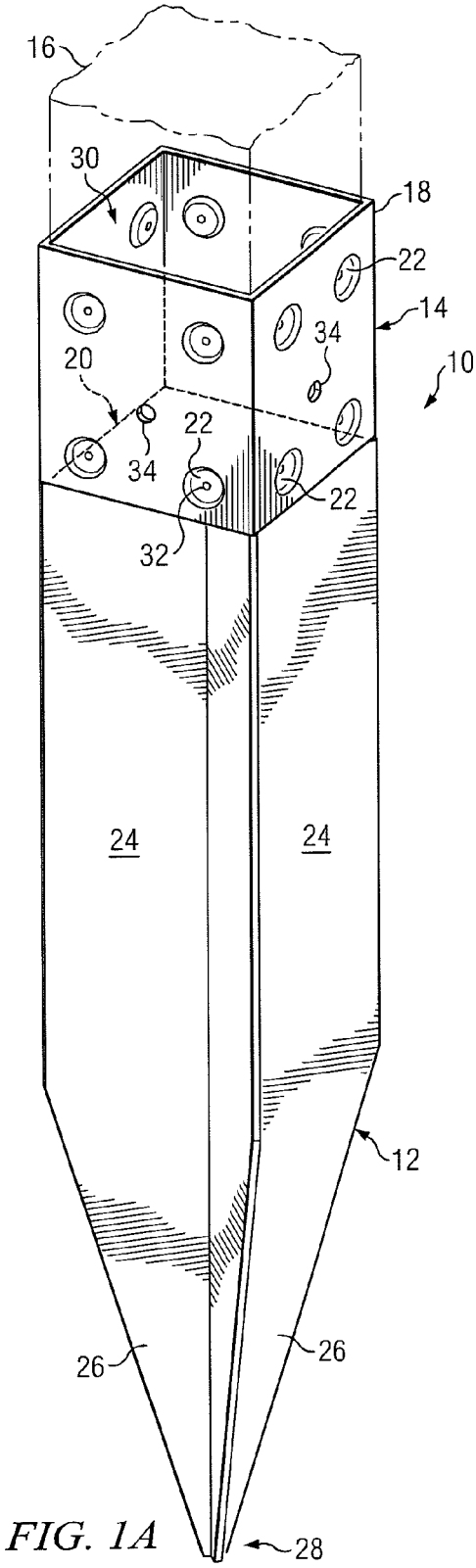
FIGS. 1A and 1B are perspective views of a post anchor.

In the Drawings, like reference numerals refer to like or similar parts. Applicants incorporate by reference co-pending United States applications for patent Ser. Nos. 11/593,396 and 11/593,438 which were both filed on Nov. 6, 2006. Applicants further reference U.S. Pat. Nos. 6,461,084 and 6,560,935, the disclosures of which are hereby incorporated by reference.

Figure 1B:
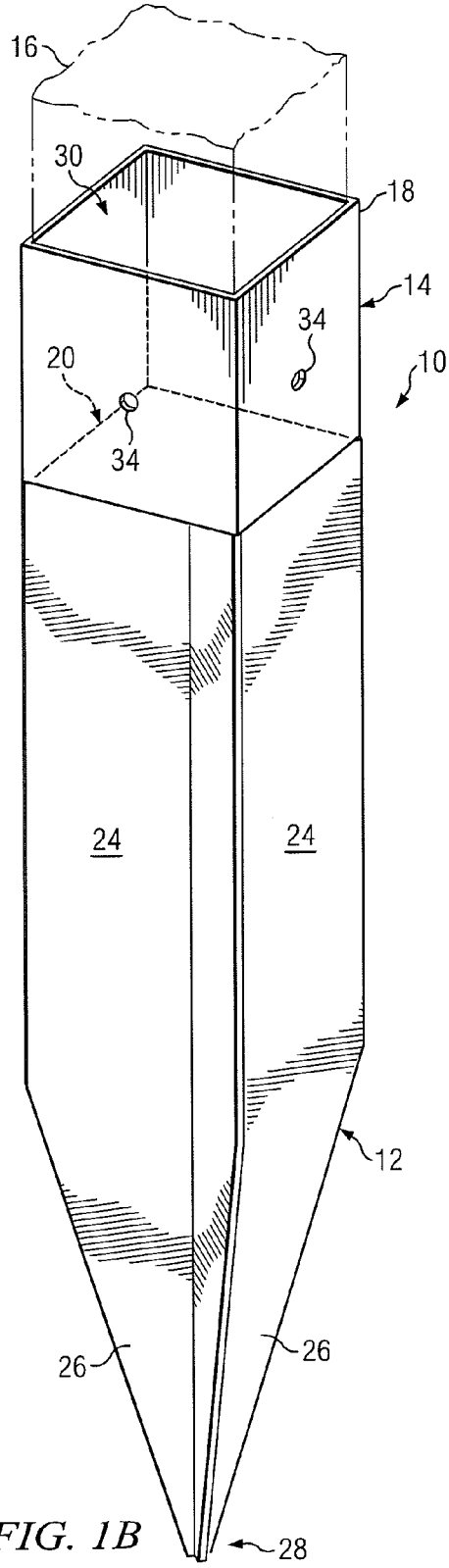

With reference to FIGS. 1A and 1B, there are shown perspective views of a post anchor 10. The post anchor 10 comprises a ground engaging portion 12 and a post receiving portion 14. FIGS. 1A and 1B illustrate that the post receiving portion 14 has received a post 16 (shown in phantom). The post 16 may be any suitable vertical supporting member used in a deck, shed and other light framed construction structure which needs to be supported and secured above the ground. Although the post receiving portion 14 is illustrated as having a generally square cross-section, it will be understood that it may instead have any suitable cross-section complementary to receiving the post 16. In other words, the cross-section of the post receiving portion 14 should have a size and shape which is about the same as (generally slightly larger than) the size and shape of the cross-section of the post 16 which is to be received therein. Examples of other suitable cross-sections for the post receiving portion 14 include rectangular and circular.

As discussed above, the post receiving portion 14 is generally larger, at least at or about a top 18 of the post receiving portion 14, than the post 16 which is to be received. The post 16 is inserted into the slightly larger opening in the post receiving portion 14 at the top 18 and pushed down into the opening in the post receiving portion 14 until the received post 16 is seated at a base 20 (see, FIGS. 2A and 2B) of the post receiving portion 14 (or otherwise when further downward advancement of the post 16 is stopped).

In the embodiment of FIG. 1A, the post receiving portion 14 includes a number of inwardly-projecting impressions (or dimples) 22. The term "inwardly" in this context refers to a direction oriented towards an inside of the post receiving portion 14. These impressions 22 engage an outer surface of the post 16 as the post is being inserted into the opening in the post receiving portion 14. These impressions 22 function to resist axial movement of the post 16 with respect to the post anchor 10. In other words, the impressions 22 will resist removal of the post from post receiving portion 14 of the post anchor 10 following insertion. The connection is initiated when the post 16 is inserted into the larger top portion 18. The post 16 will make physical contact with the impressions 22 as the post 16 is forced further into the post receiving portion 14. In some instances, given the clearances involved, the outer surface of the post 16 may be deformed (or otherwise marred or scarred) by the impressions 22 as the post 16 is inserted into the opening on the post receiving portion 14.

The impressions 22 are shown in FIG. 1 as having a generally circular shape. It will be understood that the impressions may have any suitable shape provided sufficient extension in the inwardly direction is provided so as to engage the outer surface of the inserted post 16. The impressions 22 are formed by stamping the desired impression shape (in the illustrated example: a circular shape) in the sheet metal forming the post receiving portion 14. Because of the stamping process which is used, the inwardly projecting impressions have radiused peripheral edges 33 (see, FIG. 3A) and a contact surface 35 (see, FIG. 3A). This structural configuration is of some importance because it allows for clamping of the received post 16 to occur without the use of a spike or barb-like structure to physically dig into the post surface. Thus, a secure retention is provided which nonetheless still would permit removal of the post from the anchor if desired without necessarily damaging the anchor. The structural configuration is further advantageous because it obviates the need to use a compressive cap or an inserted wedge to retain the post. Thus, this reduces the parts count needed for an installation.

The embodiment of FIG. 1B omits use of the impressions 22 in favor of the use of other securing means such as adhesive or screws passed through openings 34.

The ground engaging portion 12 includes a plurality of fins 24. The fins taper at a lower portion 26 thereof to form a point 28 which aids insertion of the ground engaging portion 12 into the ground. Although a finned structure is preferred, it will be appreciated that a solid structure, or indeed a variety of other structures, will be suitable.

Figure 2A:
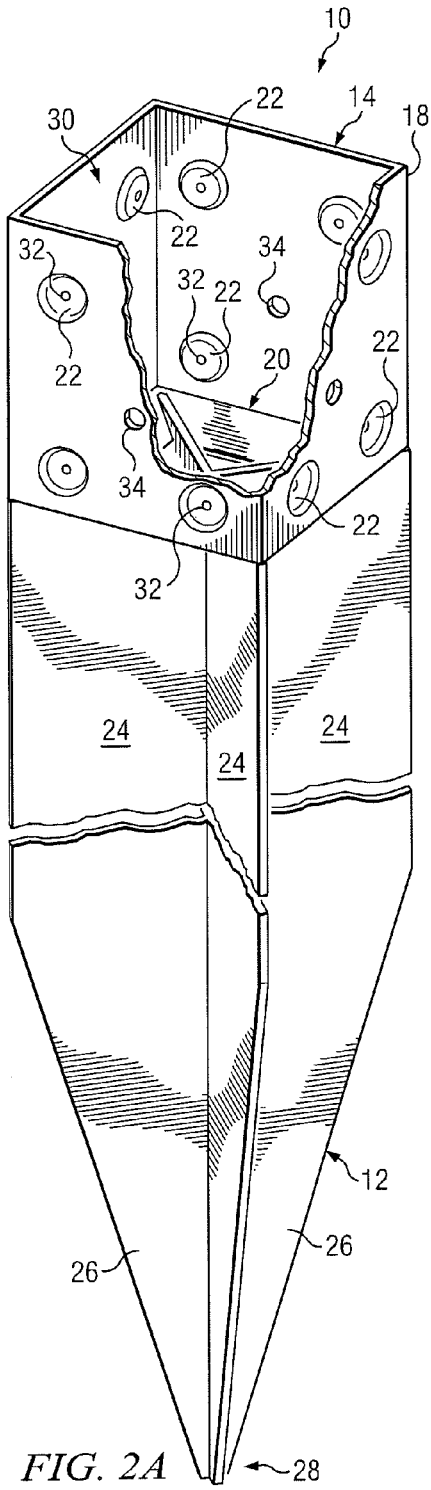
FIGS. 2A and 2B are perspective views of the post anchor of FIGS. 1A and 1B, respectively, with the post removed and with a portion of the post receiving portion cut-away to reveal interior features and designs.
Figure 2B:
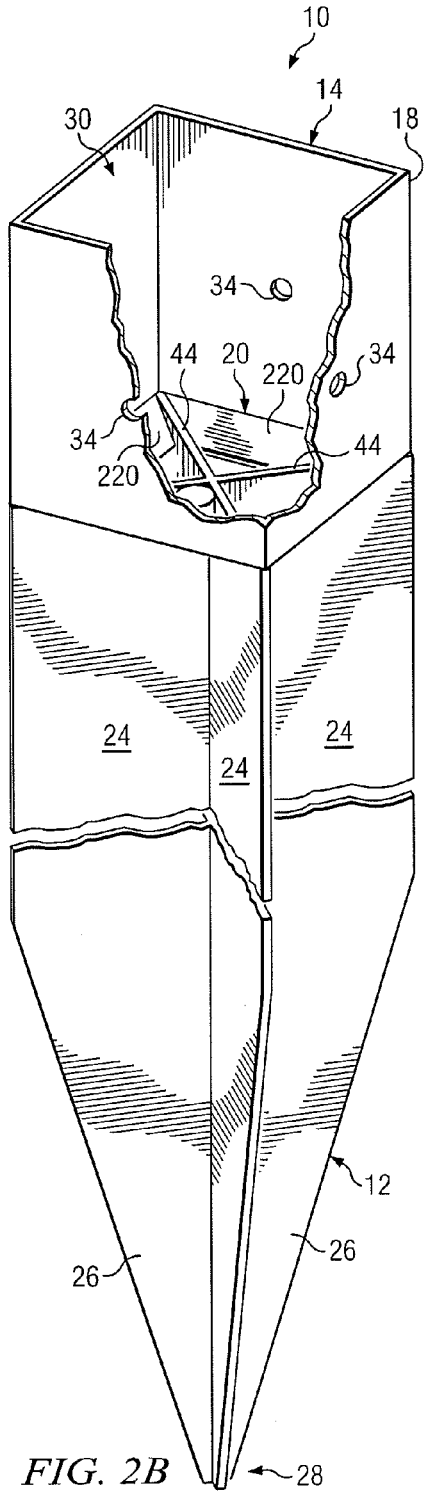

Reference is now made to FIGS. 2A and 2B wherein there are shown perspective views of the post anchor 10 of FIGS. 1A and 1B, respectively, with the post 16 removed and with a portion of the post receiving portion 14 cut-away to reveal interior features and designs. FIG. 2A illustrates that a number of impressions 22 are provided, and that these impressions 22 are preferably located on all sides of the post receiving portion 14 and are further provided at a number of positions such that some are located nearer the top 18 while others are located nearer the bottom 20. It will be noted that the location and shape of the impressions 22 can vary. Again, the post receiving portion 14 provides an opening 30 having a size and shape selected to receive a generally correspondingly shaped post 16. The post 16 is thus received by and fits within the opening 30.

An aperture 32 is provided in each impression 22. This aperture is designed to allow for the insertion of a screw there-through, with any such screw engaging a received post 16 so as to further assure retention of the post 16 within the post receiving portion 14. Advantageously, the impression 22 creates a counter-sinking depression on the outer surface of the post receiving portion 14 within which the inserted screw can sit after installation and not protrude (or not protrude as much) out from the outer surface of the post receiving portion 14. Tightening of the inserted screws to engage the post 16 can cause further extension of the impressions 22 in the inwardly direction so as to even more securely engage the outer surface of the received post 16.

In both FIGS. 2A and 2B, another aperture 34 is provided on one or more sides of the post receiving portion 14. This aperture 34 in one implementation forms a blot/glue port. Through the blot/glue port an installer may inject an adhesive material into the opening 30 of the post receiving portion 14. Preferably, the adhesive is injected through the blot/glue port after the post 16 has been inserted into the opening. In such a case, the injected adhesive will spread to fill the space between the outer surface of the post 16 and the inner surface of the post receiving portion 14 which is formed by the inwardly extending impressions 22. The adhesive, when dried or cured, functions to further assure retention of the post 16 within the post receiving portion 14.

It will be recognized that the aperture 34 may alternatively, or additionally, be used to allow for the insertion of a screw (or bolt) there-through, with any such screw/bolt engaging a received post 16 so as to further assure retention of the post 16 within the post receiving portion 14.

Figure 3A:
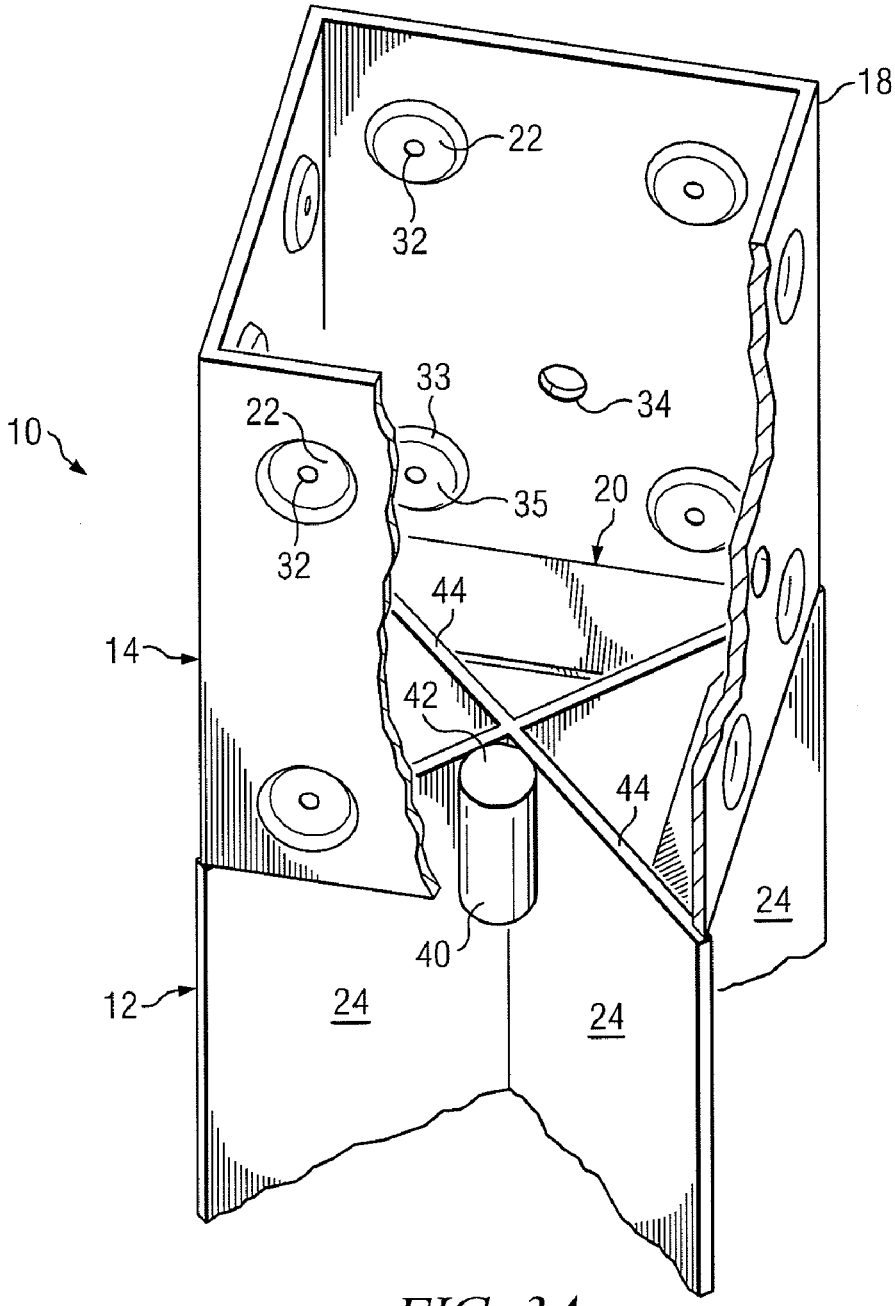
FIGS. 3A and 3B are perspective views of the post receiving portion (discussed above) with a portion of the post receiving portion cut-away to reveal interior features and designs.
Figure 3B:
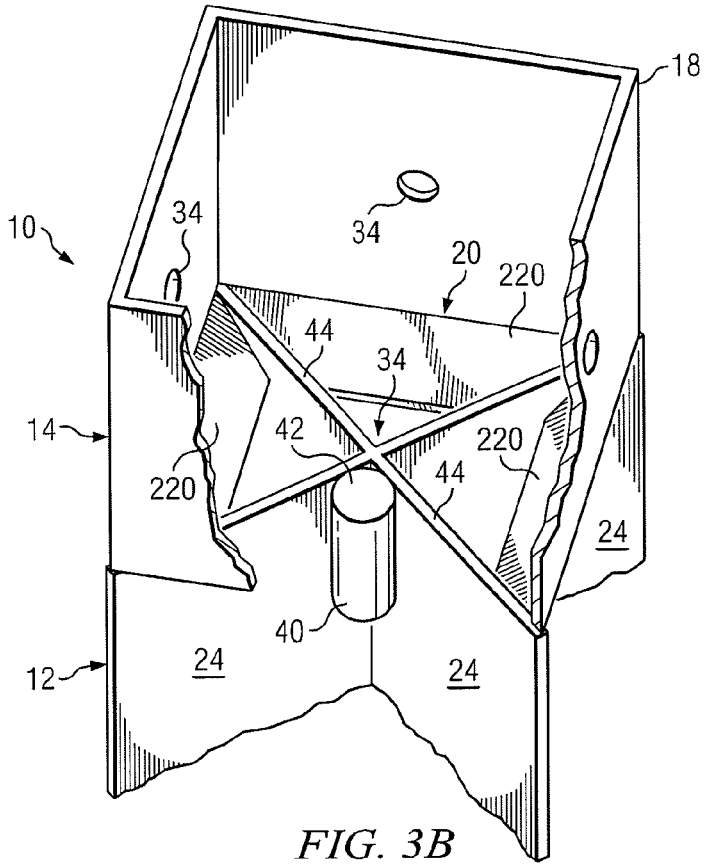
Figure 4:
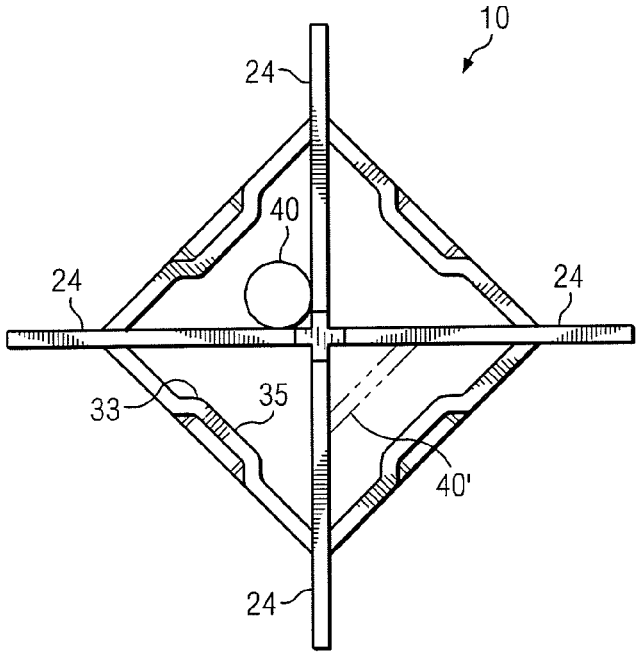
FIG. 4 is a top view of a post anchor.

Reference is now made to FIGS. 3A and 3B wherein there are shown perspective views of the post receiving portion 14 (in each embodiment discussed above) with a portion of the post receiving portion cut-away to reveal interior features and designs. A drive pin 40 made of solid round steel bar stock is mounted to the ground engaging portion 12 a corner formed between two adjacent fins 24. A top surface 42 of the drive pin 40 is located flush with the top edge 44 of the fins 24. The drive pin 40 is welded in the corner location preferably near the center of the fin cross section (see, FIG. 4). The drive pin can be made of several profiles and sizes but its location is most preferably flush with the top edge 44 of the fins 24. The drive pin 40 functions to distribute the energy used to drive the post anchor 10 into the ground over a larger area of the fins 24 so as to help minimize damage to the fins 24 caused by operation of the driving tool. More specifically, the drive pin 40 helps to ensure that the fins 24, at or near the top edge 44 are not severely crumpled through the pounding action of the driving tool during installation of the post anchor 10 into the ground. The drive pin 40 further secures the welding seam between the fins 24 at or near the top edge 44. Although solid round bar stock is preferred, in another implementation the drive pin 40 can have a hollow tubular shape. In yet another implementation, the drive pin can instead comprise a plate-like structure drive pin 40' welded to and extending diagonally between two adjacent pins (see, phantom illustration in FIG. 4). Again, a top edge of the drive pin 40' would be located most preferably flush with the top edge 44 of the fins 24.

Figure 5:
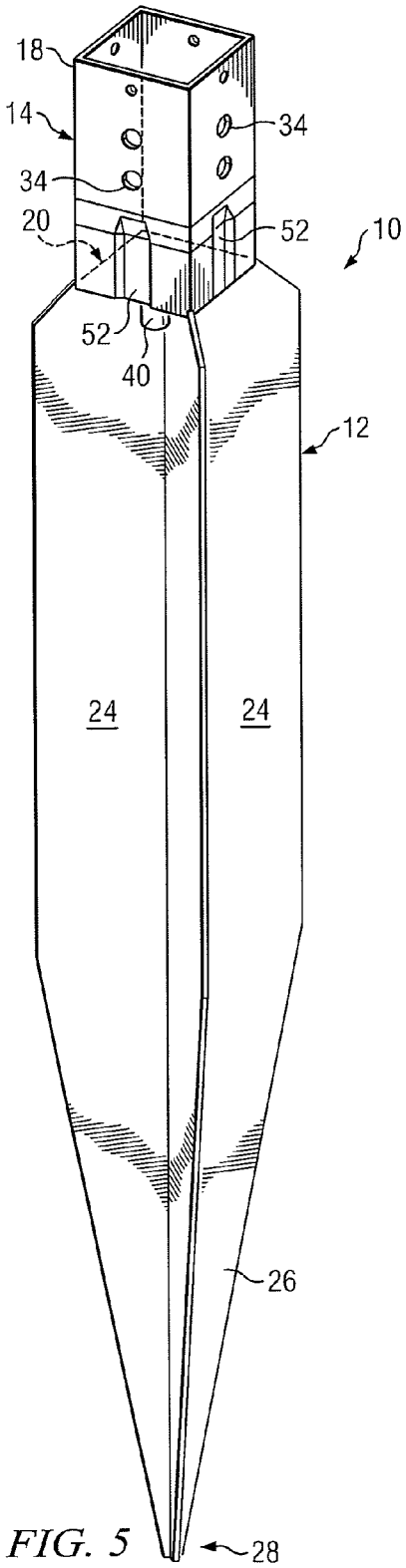
FIG. 5 is a perspective view of an alternative embodiment post anchor.

Reference is now made to FIG. 5 for a discussion of a second embodiment of a post anchor 10 in accordance with the present invention. The second embodiment shares a number of structures and features in common which will not be further described. Reference is made to the discussion above with respect to FIGS. 1-3.

As shown most clearly in FIG. 5, this embodiment of the post anchor 10 includes an impression structure in the form of an inwardly projecting linear segment impression 52. The linear segment impression 52 is positioned at or near the bottom 20 of the post receiving section 14 and in a preferred implementation is angled such that the amount of inward projection increases in height along the length of the segment impression 52 towards the bottom 20. These impressions 52 engage an outer surface of the post 16 as the post is being inserted into the opening in the post receiving portion 14. More specifically, the angled linear segment impressions 52 form a clamping structure which engages the post 16 more tightly as the post is inserted further into the opening 30. These impressions 52 function to resist axial movement of the post 16 with respect to the post anchor 10. In other words, the impressions 52 will resist removal of the post from post receiving portion 14 of the post anchor 10 following insertion. The connection is initiated when the post 16 is inserted into the larger top portion 18. The post 16 will make physical contact with the impressions 52 as the post 16 is forced further into the post receiving portion 14. In some instances, given the clearances involved, the outer surface of the post 16 may be deformed (or otherwise marred or scarred) by the impressions 52 as the post 16 is inserted into the opening on the post receiving portion 14.

The impressions 52 shown in FIG. 5 may have any suitable linear segment shape provided sufficient extension in the inwardly direction is provided so as to engage the outer surface of the inserted post 16. The impressions 52 are formed by stamping the desired impression shape (in the illustrated example of FIG. 5 a linear segment of channel shape) in the sheet metal forming the post receiving portion 14. Because of the stamping process which is used, the inwardly projecting impressions have radiused peripheral edges 33 (see FIG. 4) and a contact surface 35. This structure configuration is of some importance because it allows for clamping of the received post 16 to occur without the use of a spike or barb-like structure to physically dig into the post surface. Thus, a secure retention is provided which nonetheless still would permit removal of the post from the anchor if desired. The structure configuration is further advantageous because it obviates the need to use a compressive cap or an inserted wedge to retain the post. Thus, this reduces the parts count needed for an installation.

The placement of the impressions 52 only at or near the bottom 20 of the post receiving portion 14 assists in installation of the post in a plumb relationship. The impressions engage the lower portion of the post 16 when seated in the opening of the post receiving portion 14. This allows for gaps at or near the top 18 of the post receiving portion 14 to be present. By rocking the post 16 within the post receiving portion 14, adjustments to achieve a plumb installation can be made. Once plumb is established, the apertures 34 can be used for adhesive insertion or screw insertion in order to secure the post in that established plumb position.

The above description has been made in terms of a four fin 24 ground engaging portion 12. The invention is not limited to this situation. In fact, the ground engaging portion 12 may be a single fin or spike. The four fin 24 arrangement, however, is the most suitable in many applications.

It will be appreciated that the post anchor 10 described above provides a secure association of the post 16 to the post anchor 10 by virtue of the impressions 22/52 that make a secure engagement with the post 16. With this design the post receiving portion 14 can be completely or partially buried in the ground so the final appearance is visually pleasing and functionally superior to the prior art. Furthermore, should the post become damaged, it can be replaced by removal of the securing hardware and post. A new post can then be placed into the post receiving portion and forced into the impressions to make a secure engagement with the post.

Figure 6:
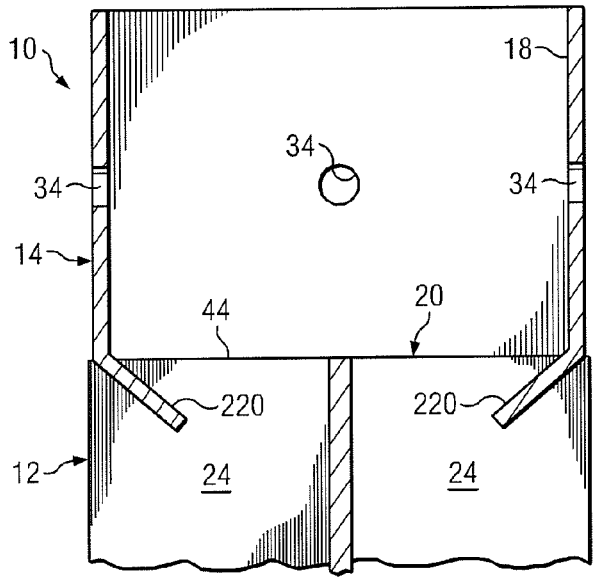
FIG. 6 is a cross-sectional view of post receiving portion of FIG. 1B.

Reference is now made to FIG. 6 which illustrates a cross-sectional view through a post receiving portion. The side walls of the post receiving portion 14 taper inwardly below the base 20 as generally shown at reference 220. A top edge 44 of the fins 24 forms the base 20 of the opening 30. The tapered portion 220 of the sidewalls form a trapezoidal shape extending below the top edge 44 with edges that are secured by welding to the fins 24. The inward tapering of the portion 220 of the side walls forms a wedge-like structure that advantageously pushes (or displaces) ground out away from the center of the post anchor during installation. Additionally, the portion 220 in being secured to the fins 24 just below the top edge 44 of the fins 24 provides a structural support to help minimize damage to the fins 24 caused by operation of the driving tool during installation of the post anchor into the ground. More specifically, the portion 220 helps to ensure that the fins 24, at or near the top edge 44 are not severely crumpled, displaced or bent through the pounding action of the driving tool during installation of the post anchor 10 into the ground.

Figure 7:
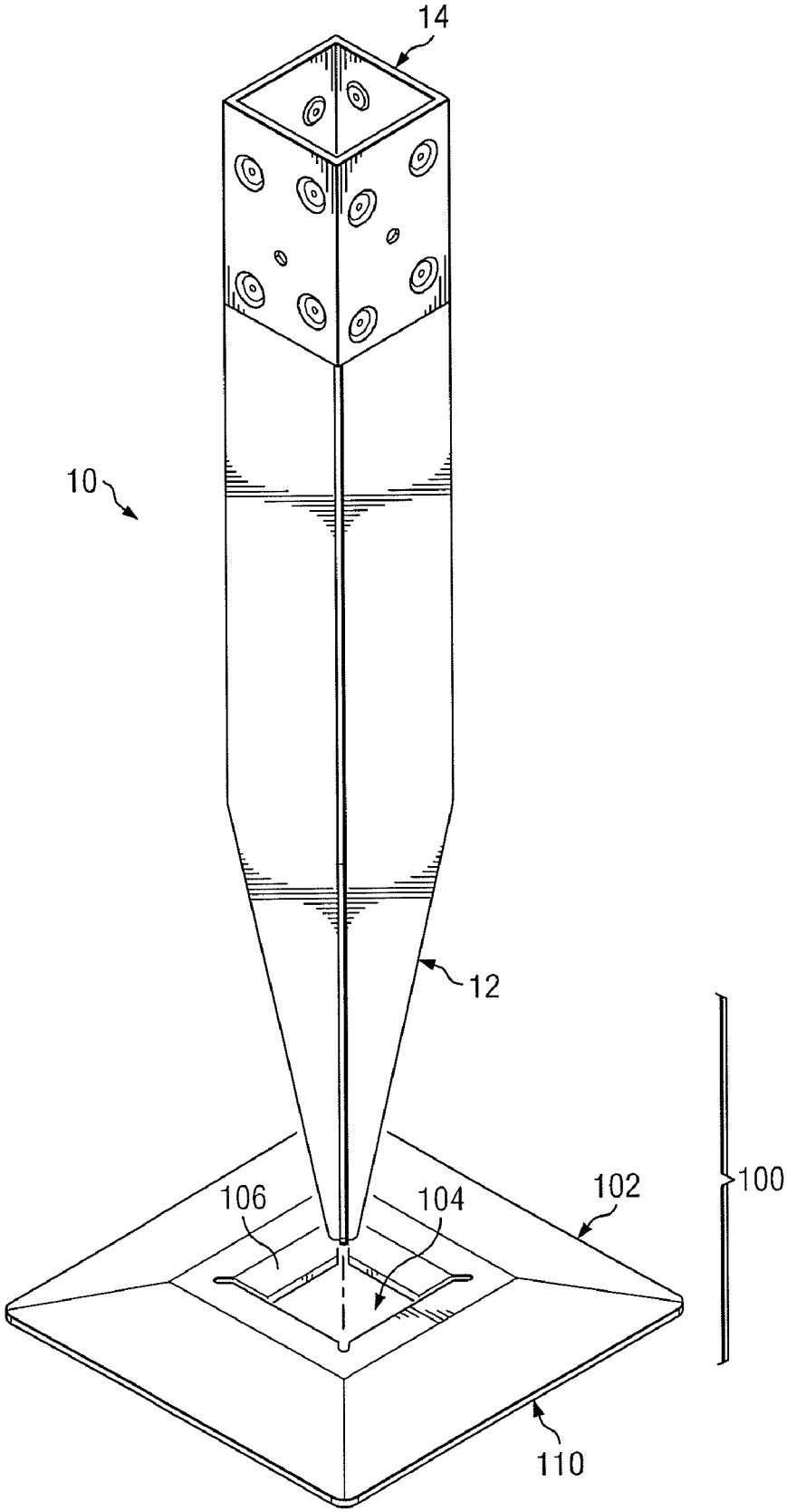
FIG. 7 is a perspective view of a post anchor and weight distribution plate assembly in an unassembled state.

Reference is now made to FIG. 7 wherein there is shown a perspective view of a post anchor and weight distribution plate assembly 100. The assembly 100 includes a post anchor 10 (in this case being the anchor of FIG. 1A, but alternatively other anchors of similar design could be used), and a weight distribution plate 102. The plate 102 includes an opening 104 in its center which is sized and shaped to receive the ground engaging portion 12 of the anchor 10 extending there through up to a point where a bottom edge of the post receiving portion 14 engages an upper surface 106. The use of the assembly 100 is advantageous because a retailer can separately stock the anchor 10 and plate 102 in inventory. This allows for the separate sale of the anchor 10 for use in, for example, fencing installations. For use with a structural support application, the assembly 100 can instead be sold. This obviates the need to manufacture and stock in inventory a combined anchor and plate assembly.

Figure 8:
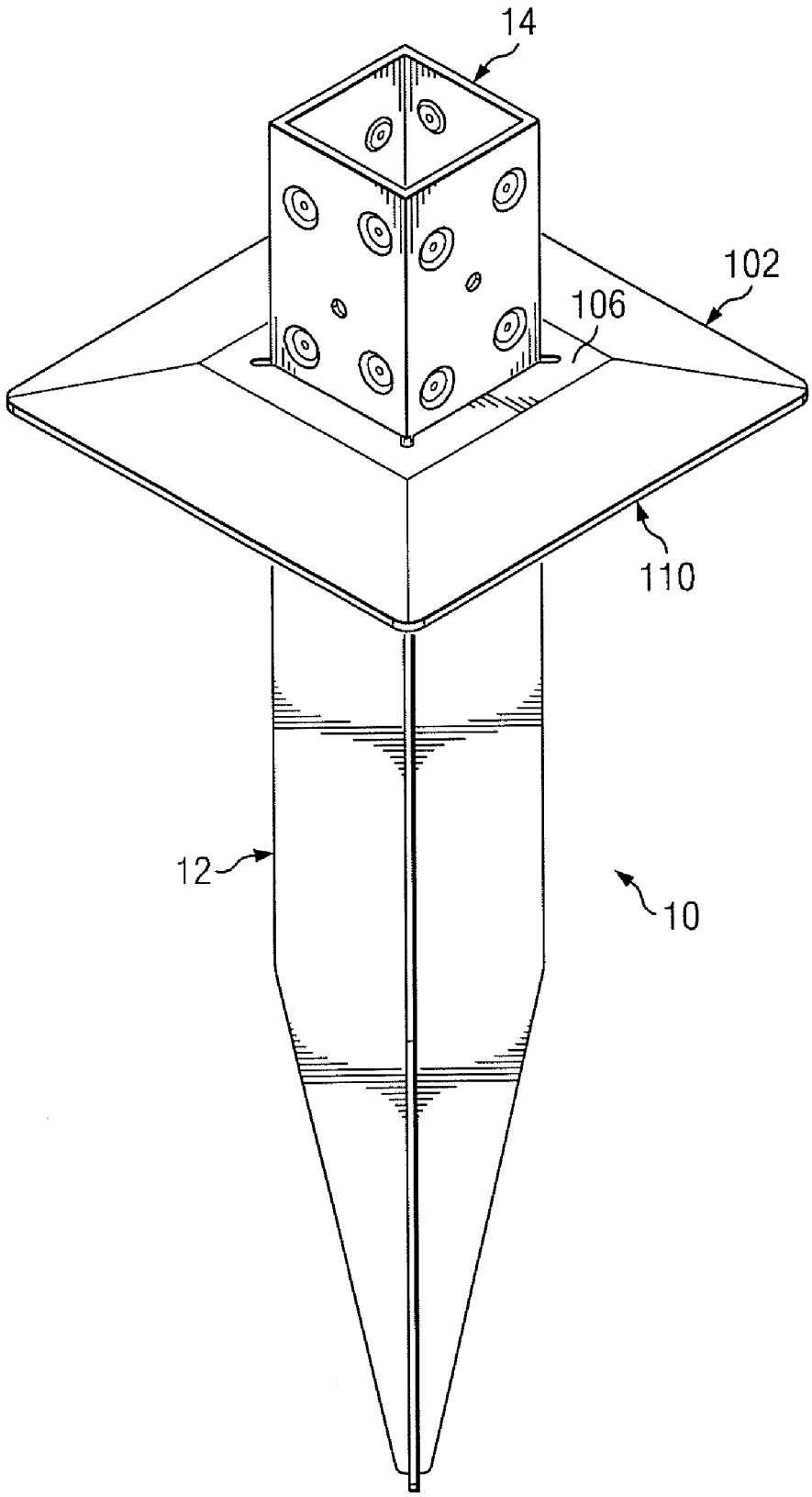
FIG. 8 is a perspective view of a post anchor and weight distribution plate assembly in an assembled state.

FIG. 8 illustrates a perspective view of the post anchor and weight distribution plate assembly 100 in an assembled state wherein the ground engaging portion 12 of the anchor 10 has fully passed through the opening 104 and the bottom edge of the post receiving portion 14 has engaged the upper surface 106. It will be recognized that FIG. 8 further illustrates an alternative implementation wherein the post anchor and weight distribution plate assembly 100 is manufactured in an assembled state with the ground engaging portion 12 of the anchor 10 secured (for example, by welding) to the upper surface 106 of the weight distribution plate 102.

The ground plate 102 is formed to have a cupped shape (i.e., the upper surface 106 is convex while a lower surface 110 is correspondingly concave. This cupped shape serves at least two functions. First, when the assembly 100 is installed, the cupping of the plate 102 (through the concave lower surface 110) compresses the underlying soil into and against the ground engaging portion 12 of the post support anchor 10. Second, the bends in the structure of plate 102 used to form the cupped shape provide additional resistance to bending of the plate during installation and further use.

The weight distribution plate 102 can be square, round or any other useful shape. The post receiving portion 14 could be formed to adapt for all types of posts such as steel, aluminum, wood, plastic and composite materials in a wide range of sizes and shapes.

Larger and thicker plates 102 could be made for larger test loads and smaller and thinner plates could be made for lighter loads.

Holes (not shown) may be provided in the plate 102 for use in temporarily locating the plate during the construction process. In addition the holes provide a visual aid to inspect the compaction of the soil below the plate. The holes, however, are not required for the design to function but are included primarily to improve installation ease.

Installation of the assembly 100 is as follows. The jackhammer installation method is preferred as the jackhammer acts as a driving device for the post support anchor 10 and also a compaction tool for the plate 102. When the bottom edge of the post receiving portion 14 of the post support anchor 10 bottoms out on the top surface 16 of the deck plate, the jackhammer vibrates the entire assembly and produces a compaction effect to assure that the supporting soil underlying the plate and surrounding the ground engaging portion 12 of the post support anchor 10 is compacted to a density that can support the design load.

Figure 9:
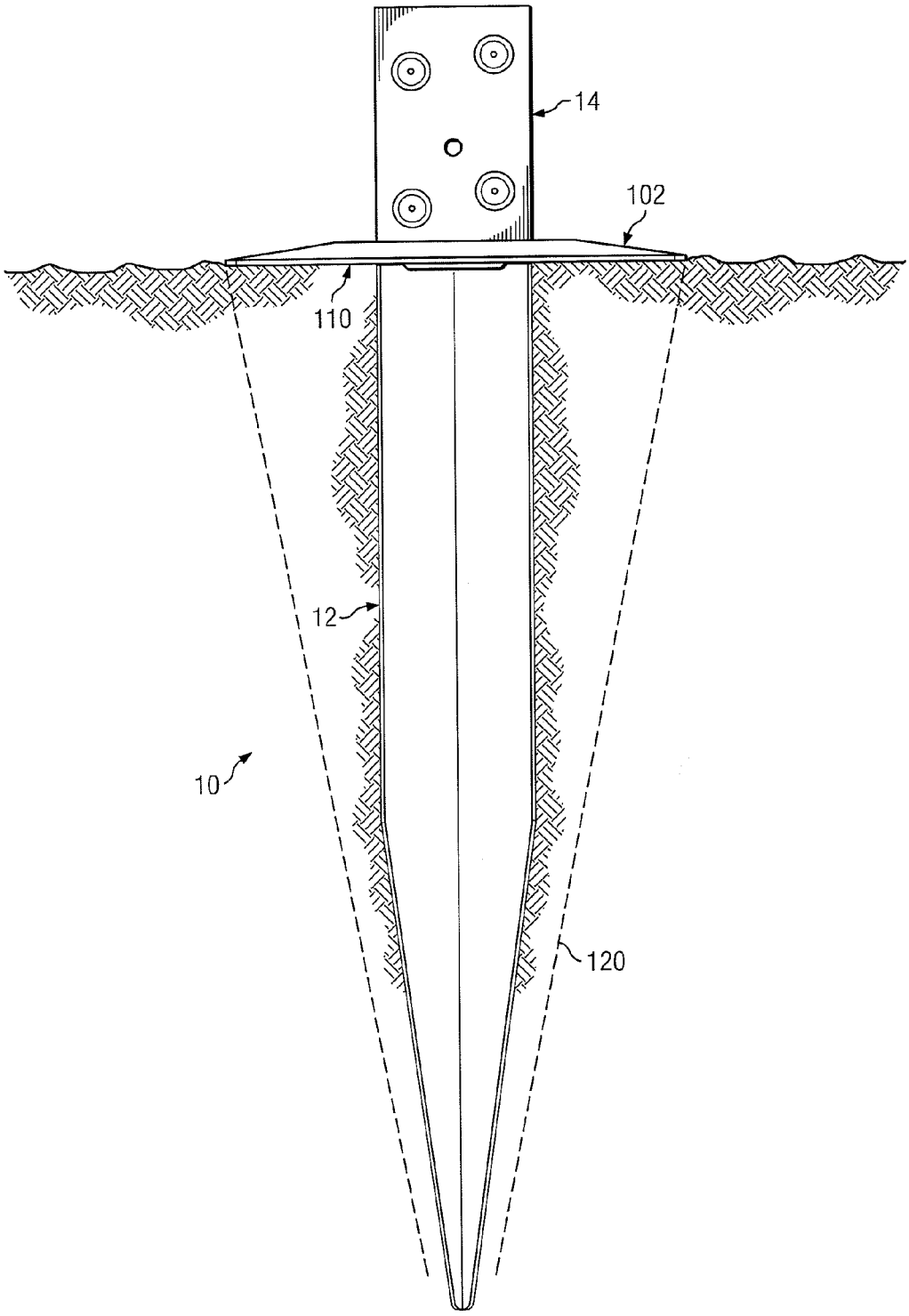
FIG. 9 is a side view of a ground installed post anchor and weight distribution plate assembly.

The cupped shape of the plate 102 is such that the when the plate is compacted with the jackhammer the soil is forced toward the center of the post support and also provides a means to remove voids and air pockets in the soil to produce a stronger foundation. The result is a cone shaped area 120 (see, FIG. 9) of highly compressed soil that is more densely compacted than the surrounding soil.

The jackhammer installation method produces the best results and performance but a sledgehammer or other similar means of driving the post anchor in the ground through the deck plate 102 will also produce acceptable results.

This assembly 100 design is superior to deck blocks because in combination the post anchor and deck plate assembly 100 offers both lateral load strength and also vertical load strength. Also the post anchor provides uplift resistance from wind or other similar forces.

The deck plate 102 is preferably made of steel, but can also be made of other materials such as stainless steel, aluminum, plastic, composite plastic, and also concrete.

Figure 12:
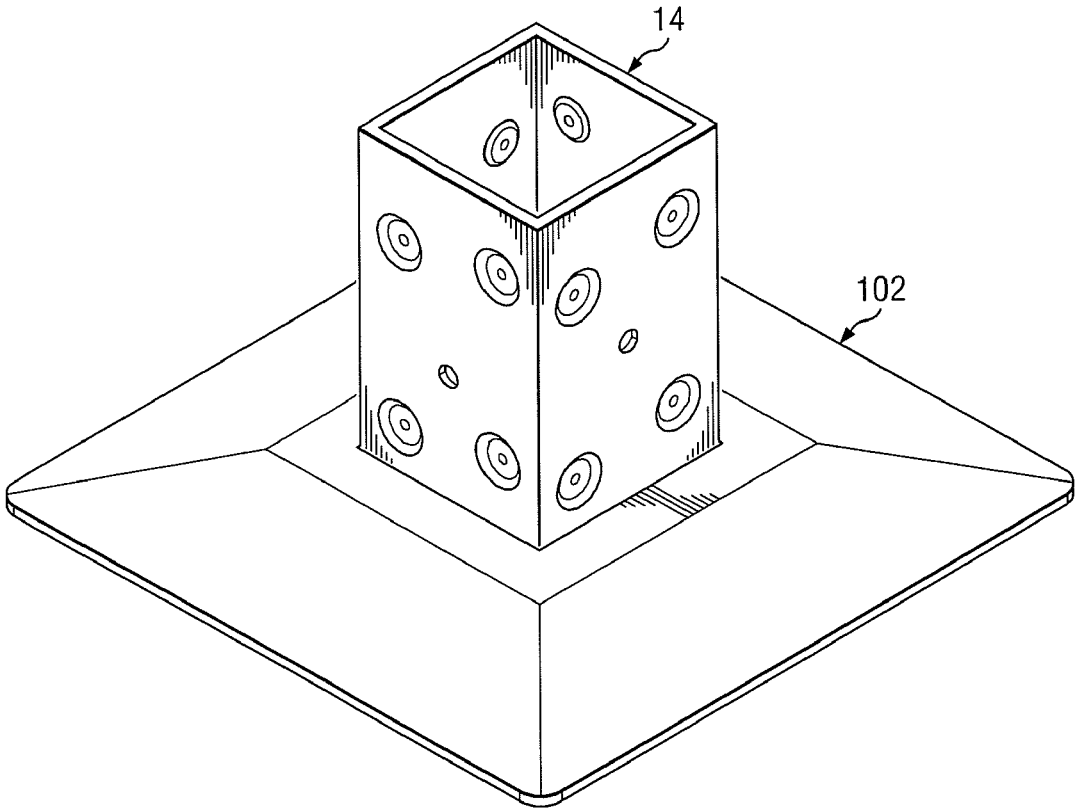
FIG. 12 is a perspective view of a post holder and weight distribution plate assembly.

The deck plate 102 does not require the use of a post anchor to work. A top sleeve 14 for supporting a post could be placed on the top of the plate 102 and fastened there with welding or screws. This type of assembly is illustrated in FIG. 12.

The deck plate 102 is preferably made of hot dipped galvanized steel to provide long lasting performance and also have resistance to preservative chemicals often found in treated lumber products. Other materials could be utilized to also produce similar resistance to deterioration.

Figure 10:
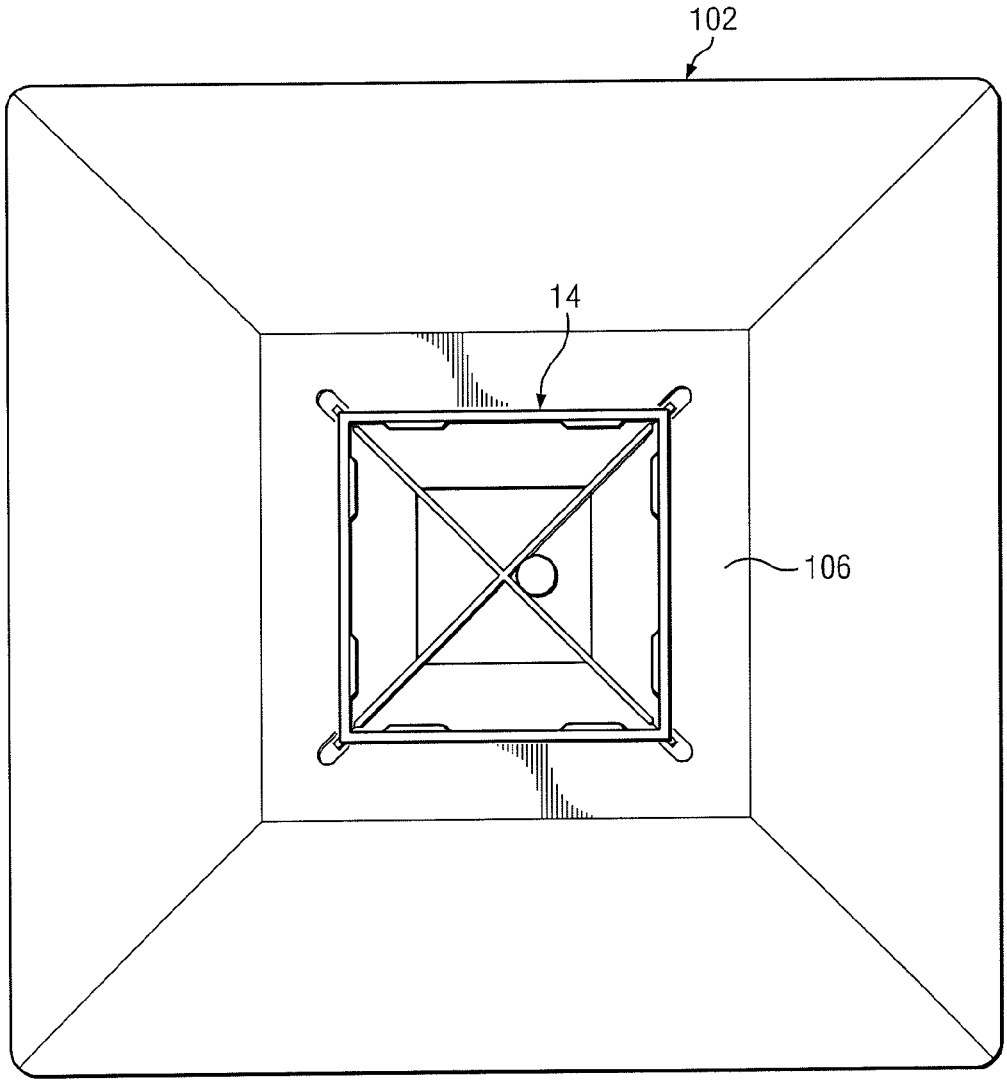
FIG. 10 is a top view of a post anchor and weight distribution plate assembly in an assembled state.

FIG. 10 is a top view of a post anchor and weight distribution plate assembly in an assembled state.

Figure 11:
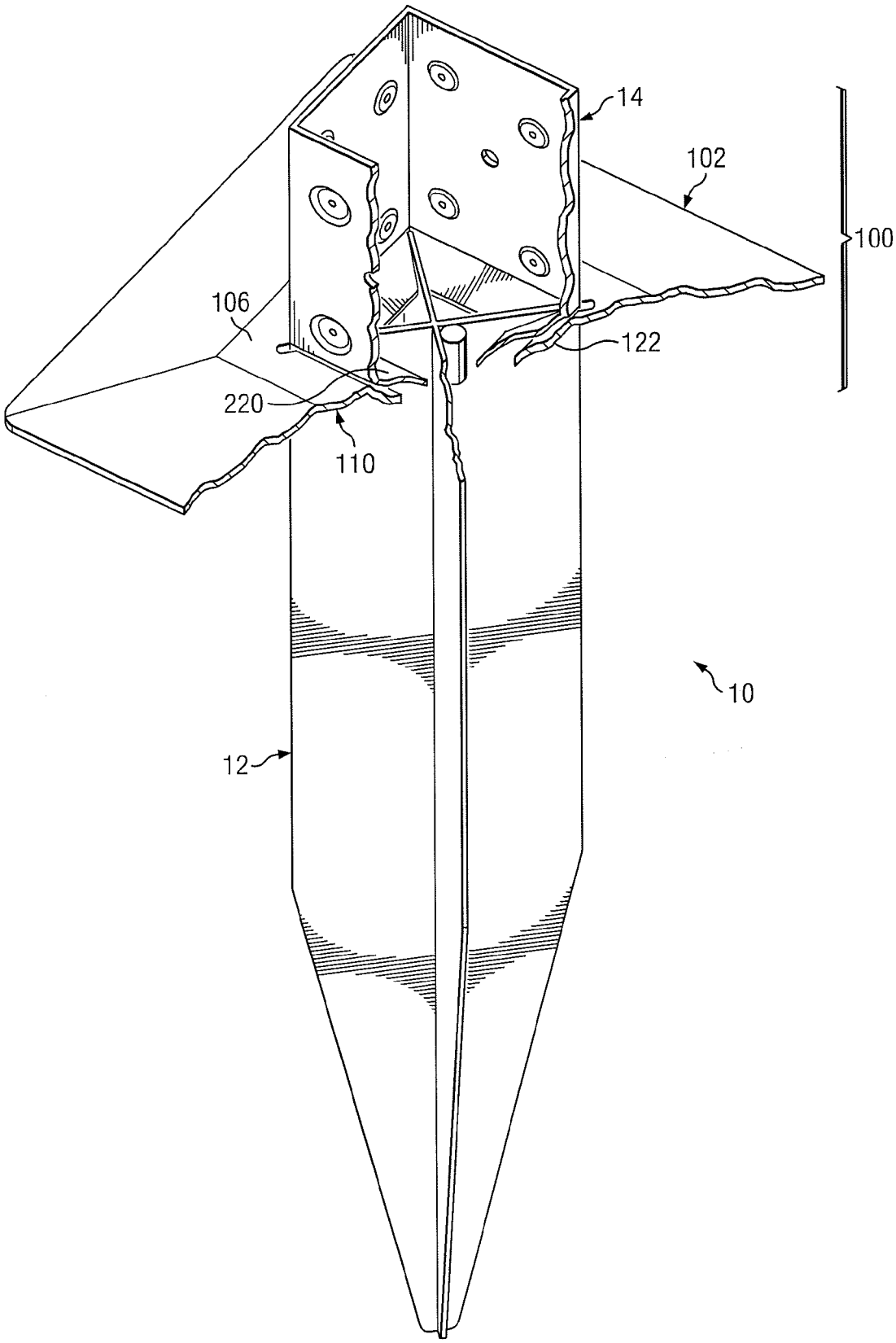
FIG. 11 is a perspective view of a post anchor and weight distribution plate assembly in an assembled state with a portion of the assembly cut-away to reveal interior features and designs.

FIG. 11 is a perspective view of a post anchor and weight distribution plate assembly in an installed state with a portion of the assembly cut-away to reveal interior features and designs. It will be noted that the tapered portion 220 of the sidewalls of the post receiving portion 14 of the post support anchor 10 is located so as to engage with a similarly shaped portion 122 of the top surface 106 of the plate 102 during installation. FIG. 11 further illustrates how the opening 104 in the center of the plate 102 is sized and shape to receive the ground engaging portion 12 of the anchor 10.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. An apparatus, comprising:

a ground anchor including a ground engaging portion in the form of a first vertically extending fin and a second vertically extending fin oriented substantially perpendicular to the first vertically extending fin and further including a post receiving portion including a bottom surface, wherein the first and second vertically extending fins extend from the bottom surface towards an end of the ground engaging portion; and a weight distribution plate including an aperture sized and shaped to receive the ground engaging portion extending there through, the aperture comprising a first slot through which the first vertically extending fin of the ground engaging portion extends and a second slot intersecting and substantially perpendicular to the first slot and through which the second vertically extending fin of the ground engaging portion extends, and wherein the bottom surface of the post receiving portion engages a top surface of the weight distribution plate;

wherein the to surface of the weight distribution plate defines a convex surface, the weight distribution plate further including a bottom surface which defines a corresponding concave surface.

2. The apparatus of claim 1 wherein the post receiving portion further comprises an inwardly sloping surface defining the bottom surface of the post receiving portion, and wherein the weight distribution plate further comprises an inwardly sloping surface complementary to the inwardly sloping surface extending from the bottom of the post receiving portion.

3. An apparatus, comprising:

a ground anchor member including a first vertically extending fin and a second vertically extending fin oriented at a non-straight angle relative to the first vertically extending fin; and a weight distribution plate member;

wherein the weight distribution plate member includes an opening therein in the form of a first slot through which the first vertically extending fin extends and a second slot, said second slot intersecting the first slot at a non-straight angle relative to the first slot, through which the second vertically extending fin extends;

wherein the weight distribution plate member has a convex upper surface and a concave lower surface; and wherein the ground anchor member includes a bottom surface that presses against the convex upper surface of the weight distribution plate member and the first and second fins of the ground anchor member pass through the first and second slots in the weight distribution plate member.

4. The apparatus of claim 3 wherein the ground anchor member and weight distribution plate member are separate physical components which are assembled together for use.

5. The apparatus of claim 3 wherein the ground anchor member and weight distribution plate member have complementary surfaces which engage each other.

6. The apparatus of claim 3 wherein the non-straight angle is substantially a perpendicular angle.

* * * * *

UNITED STATES PATENT AND TRADEMARK OFFICE

CERTIFICATE OF CORRECTION

PATENT NO. : 8,082,702 B2
APPLICATION NO. : 12/277751
DATED : December 27, 2011
INVENTOR(S) : Ian A. Hill It is certified that error appears in the above-identified patent and that said Letters Patent is hereby corrected as shown below:

In the Claims:

At column 8, claim number 1, line number 27, please replace the word [to] with the word -- top --.

Signed and Sealed this
Seventh Day of February, 2012

David J. Kappos

David J. Kappos
*Director of the United States Patent and Trademark Office*